US006659275B1

(12) United States Patent
Yoon

(10) Patent No.: US 6,659,275 B1
(45) Date of Patent: Dec. 9, 2003

(54) HEAD COVER ASSEMBLY FOR PROTECTING HEADS OF GOLF CLUBS FROM COLLIDING WITH EACH OTHER IN A GOLF BAG UNDER CARRIAGE

(75) Inventor: Kyung-Bun Yoon, Kyungki-do (KR)

(73) Assignee: Q-Boak Sports, Inc. (KR)

( * ) Notice: Subject to any disclaimer, the term of this patent is extended or adjusted under 35 U.S.C. 154(b) by 0 days.

(21) Appl. No.: 10/180,721

(22) Filed: Jun. 26, 2002

(51) Int. Cl.[7] ..... A63B 55/00; A63B 55/04

(52) U.S. Cl. ..... 206/315.3; 206/315.6; 150/160

(58) Field of Search ..... 150/160; 206/315.2, 206/315.3, 315.6

(56) References Cited

U.S. PATENT DOCUMENTS 2,128,546 A * 8/1938 Venmore ..... 206/315.2 X
2,752,973 A * 7/1956 Stamp ..... 206/315.3
2,879,819 A * 3/1959 Turnbull ..... 206/315.2
5,437,320 A * 8/1995 Sung ..... 150/160
6,044,880 A * 4/2000 Maeng ..... 150/160

* cited by examiner

*Primary Examiner*—Tri M. Mai
(74) *Attorney, Agent, or Firm*—Harness, Dickey, Pierce, P.L.C.

(57) ABSTRACT

Disclosed is a head cover assembly for holding and protecting the heads of golf clubs from colliding with each other in a golf bag having a top and a bottom shaping part fastened to a frame. It comprises a plurality of elastic head covers for respectively covering the heads of golf clubs. A rigid head cover holder is fastened to the inside of the top bottom shaping part for fixedly holding the head covers arranged at suitable intervals. The heads are respectively and fixedly held by the elastic head covers to make at least the heads substantially immovable in the golf bag under carriage.

10 Claims, 4 Drawing Sheets

HEAD COVER ASSEMBLY FOR PROTECTING HEADS OF GOLF CLUBS FROM COLLIDING WITH EACH OTHER IN A GOLF BAG UNDER CARRIAGE

BACKGROUND OF THE INVENTION

The present invention relates to a golf bag, and more particularly to a head cover assembly for holding and protecting the heads of the golf clubs in a golf bag.

It has been unavoidable for the golf clubs, especially their heads to collide with each other while carrying them in a conventional golf bag, so that they tend to be scratched from the collision to impair their aesthetics.

SUMMARY OF THE INVENTION

It is an object of the present invention to provide a golf bag with a head cover assembly for holding and protecting the heads of the golf clubs from colliding with each other in the golf bag while being carried either by the golfer or in a cart.

According to an aspect of the present invention, a head cover assembly for holding and protecting the heads of golf clubs from colliding with each other in a golf bag is provided. The assembly is designed to be inserted into a conventional golf bag and includes a frame having a top and a bottom part. A plurality of elastic head covers for covering the heads of golf clubs are attached to a holder fastened to the inside of the top frame part such that the head covers are fixed at suitable intervals, whereby the heads are respectively and fixedly held by the elastic head covers to make at least the heads substantially immovable in the golf bag.

Preferably, each of the elastic head covers comprises a head covering part for covering the head of a golf club, and an elongated elastic support strip connected to the head covering part. The elastic support strip is held by the head cover holder.

Preferably, the head cover holder comprises a pair of rigid mating plates for receiving the support strips between them, and catching device for firmly fixing the free end portions of the support strips. One of the mating plates is provided with a plurality of grooves for respectively receiving the elastic support strips so as to enable them to be freely stretched.

The present invention will now be described more specifically with reference to the drawings attached only by way of example.

BRIEF DESCRIPTION OF THE ATTACHED DRAWINGS

DETAILED DESCRIPTION OF THE PREFERRED EMBODIMENT

Throughout descriptions in connection with the drawings, there are omitted detailed descriptions of the conventional parts not required to comprehend the technical concept of the present invention.

Figure 1:
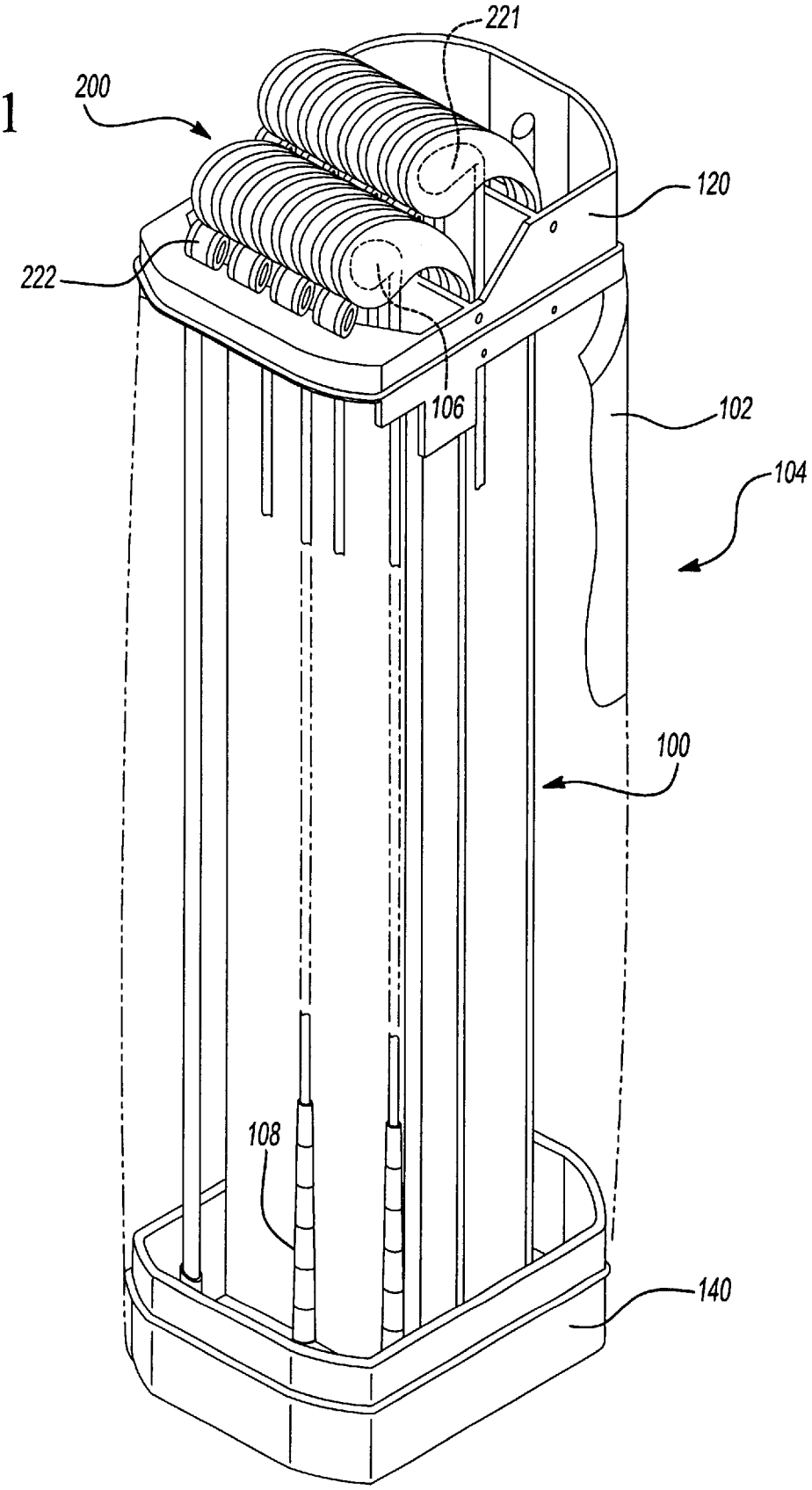
FIG. 1 is a perspective view for illustrating the inventive head cover assembly attached to the top shaping part.
Figure 2:
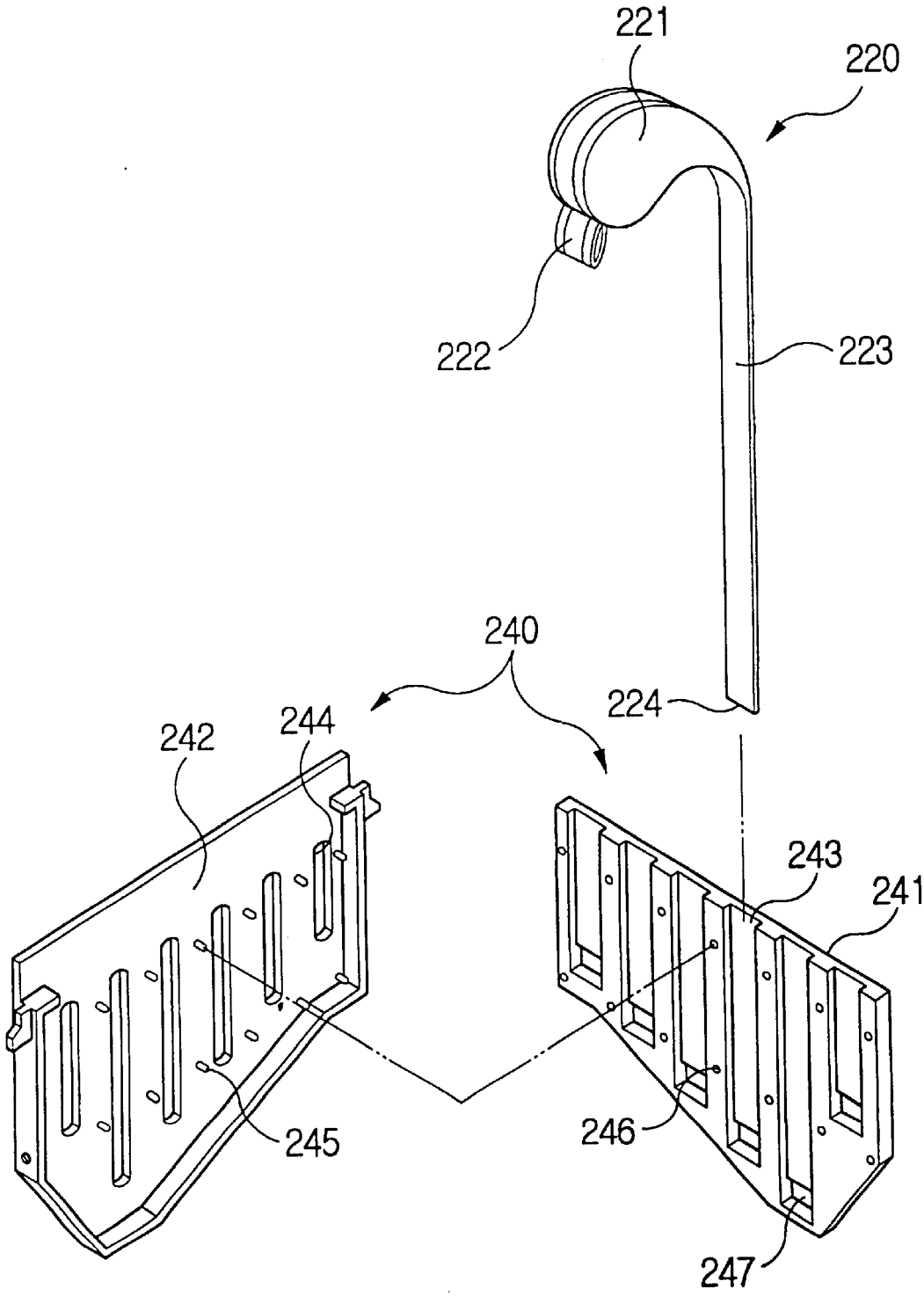
FIG. 2 is an exploded view of the inventive head cover assembly of FIG. 1.

Referring to FIG. 1, the inventive head cover assembly 200 is shown fastened to a top part 120 of a frame 100 that is covered with a suitable skin 102 such as fabric and leather to form a golf bag 104 for carrying golf clubs 106. The head cover assembly 200 comprises a plurality of elastic head covers 220 for respectively covering the heads 108 of the golf clubs 106 and a rigid head cover holder 240 fastened to the inside of the top part 120, as shown in FIG. 2. The head cover holder 240 fixedly holds the head covers 220 arranged at suitable intervals.

Referring FIG. 2, each of the elastic head covers 220 includes a head covering part 221 for covering the head of a golf club 106, and an elongated elastic support strip 223 connected to the head covering part. The elastic support strip 223 is held by the head cover holder 240. The head covering part 221 has a tab 222.

The head cover holder 240 comprises a pair of rigid mating plates 241 and 242 for receiving the support strips 223 between them. One 241 of the mating plates is provided with a plurality of grooves 243 for respectively receiving the support strips 223 so as to enable the elastic support strips 223 to be freely stretched. The other 242 is provided with a plurality of corresponding slits 244 for allowing view of the support strips 223 from the outside when mating the mating plates 241 and 242 with the support strips 223 interposed between them.

The other mating plate 242 is preferably provided with a plurality of protruding pins 245 in the surfaces around the slits 244, which are caught by corresponding pin holes 246 provided in the ridges formed around the grooves 243 of the one mating plate 241.

Figure 3:
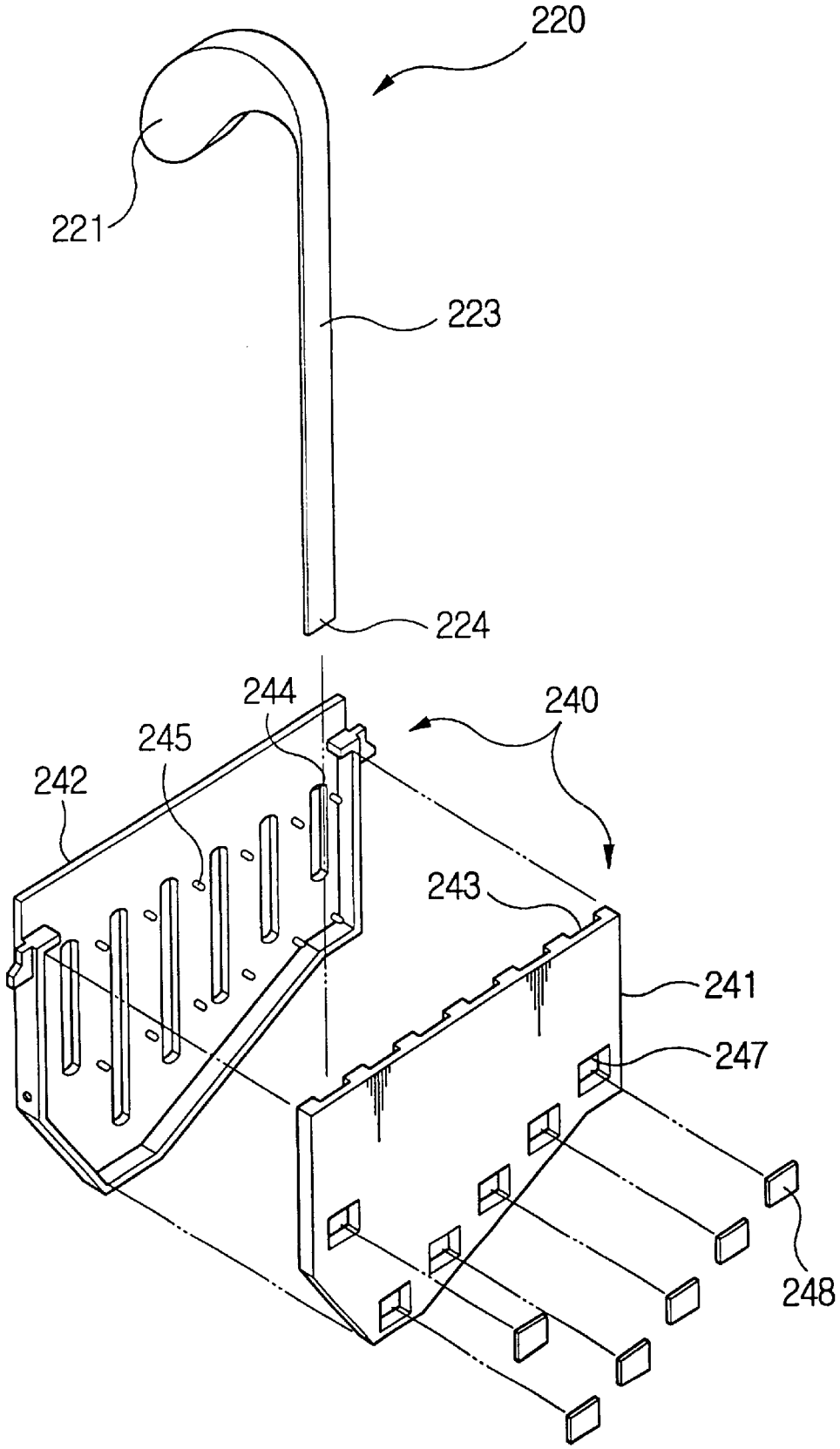
FIG. 3 is another exploded view of the inventive head cover assembly for illustrating the catching blocks securely fixed in corresponding apertures formed in the lower portion of the one mating plate.

FIG. 3 is an exploded view of the inventive head cover assembly for illustrating the relationships between the head covers 220 and head cover holder 240 and a catching device 247. In the present embodiment, the catching device comprises a plurality of rectangular apertures 247 formed in the lower end portions of the grooves 243 of the one mating plate 241 and corresponding mating rectangular blocks 248. Of course, although not shown in the drawings, the catching device may consist of a single elongated catching block securely fixed in a corresponding elongated aperture formed in the lower end portion of the one mating plate 241 so as to firmly press the free end portions of the support strips against the inside of the other mating plate 242.

Figure 4:
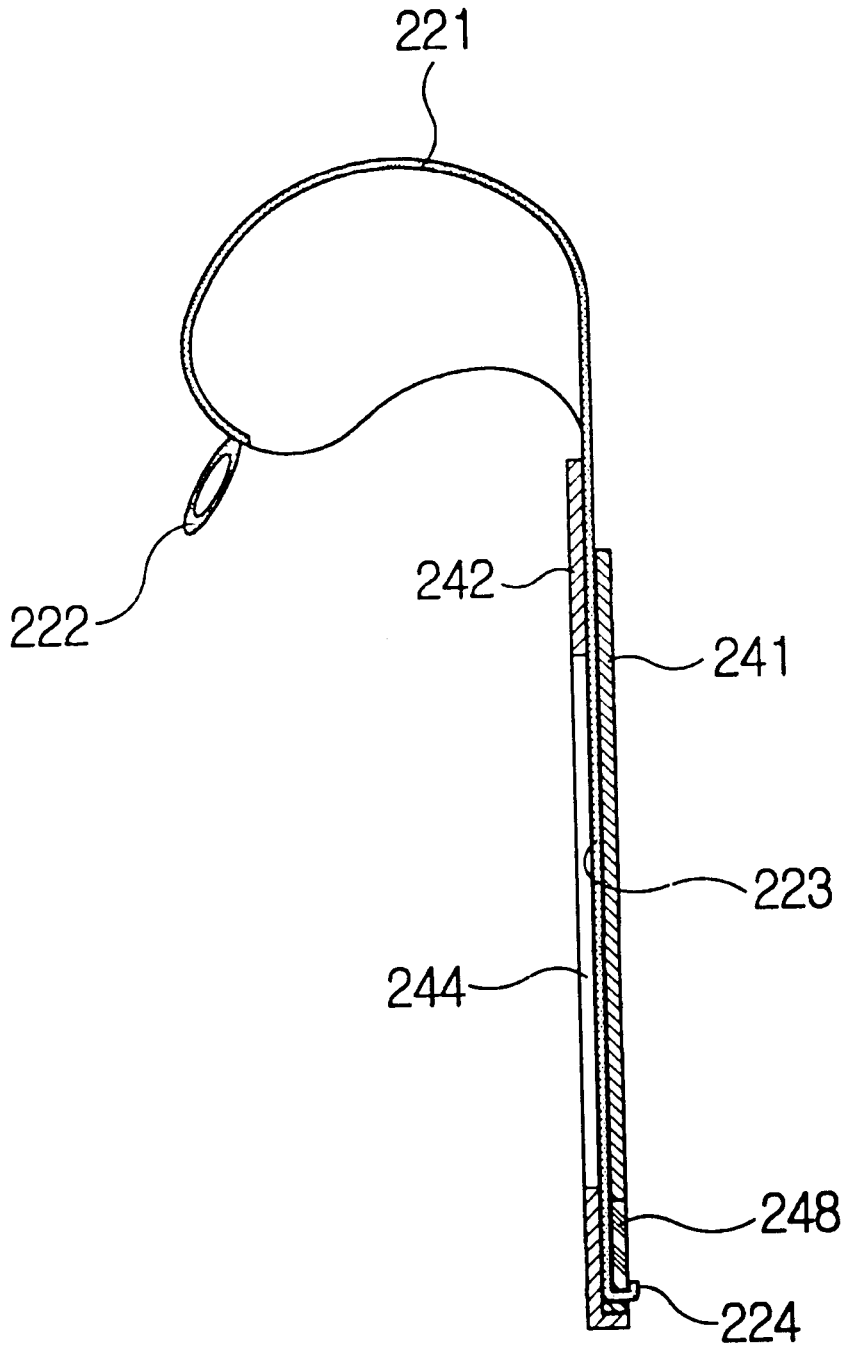
FIG. 4 is a cross sectional view of the inventive head cover assembly for illustrating the head covers with the elongated elastic support strips interposed between the mating plates.

Hereinafter is described to accomplish the head cover assembly 200 with reference to FIGS. 3 and 4. The elongated elastic support strips 223 of the head covers 220 are respectively put into the grooves 243 of the one mating plate 241 with their free end portions 224 at least fully closing the rectangular apertures 247. Then, the other mating plate 242 is mated with the one mating plate 241 with the protruding pins 245 fully inserted in and caught by the respective pin holes 246.

Thereafter, the rectangular blocks 248 are respectively and securely fixed in the rectangular apertures 247 so as to firmly press the free end portions 224 of the support strips 223 against the inside of the other mating plate 242. FIG. 4 illustrates a cross section of the head cover assembly with the elastic support strip 223 interposed between the mating plates 241 and 242. In this case, the free end portions 224 may be arranged between the mating plates 241 and 242 with the ends slightly protruding from the outside of the one mating plate, as shown in FIG. 4. Finally, the head cover assembly 200 is fastened to the top shaping part 120.

When arranging the golf clubs 106 in the golf bag 104 provided with the inventive head cover assembly 200, each golf club 106 is put into the golf bag 104 with the grip 108 positioned in the bottom of the bag. Then, the head covering part 221 is pulled upward with the tab 222 to resiliently extend the elastic support strip 223 so that the head of the golf club may be put into the head covering part 221. Thereafter, releasing the tab 222, the golf clubs are arranged substantially immovable in the golf bag by the resilient force of the elastic head covers 220, so that the heads are prevented from colliding with each other during carrying the golf bag.

While the present invention has been described in connection with specific embodiments accompanied by the attached drawings, it will be readily apparent to those skilled in the art that various changes and modifications may be made thereto without departing the gist of the present invention.

What is claimed is:

1. A head cover assembly for holding and protecting heads of golf clubs from colliding with each other in a golf bag having a top and a bottom shaping part fastened to a frame, comprising:

a plurality of elastic head covers for respectively covering the heads of golf clubs;

a rigid head cover holder fastened to the inside of said top shaping part for fixedly holding said head covers arranged at suitable intervals, whereby said heads are respectively and fixedly held by said elastic head covers so as to make at least said heads substantially immovable in the golf bag under carriage, wherein each of said elastic head covers comprises a head covering part for covering the head of a golf club, and an elongated elastic support strip connected to said head covering part, said elastic support strip being held by said head cover holder; and wherein said head cover holder comprises a Pair of rigid mating plates for receiving said elastic support strips between them, and a catching device for firmly fixing the free end portions of said elastic support strips.

2. A head cover assembly as defined in claim 1, wherein one of said mating plates is provided with a plurality of grooves for respectively receiving said support strips, and the other with a plurality of corresponding slits for allowing view of said support strips from the outside when mating said mating plates with said support strips interposed between them.

3. A head cover assembly as defined in claim 2, wherein said catching device comprises a plurality of catching blocks securely fixed in corresponding apertures formed in the lower portion of the one mating plate so as to firmly press the free end portions of said support strips against the inside of the other mating plate.

4. A head cover assembly as defined in claim 3, wherein said free end portions are arranged between said mating plates with the ends slightly protruding from the outside of the one mating plate.

5. A head cover assembly as defined in claim 2, wherein said catching device comprises a single elongated catching block securely fixed in corresponding elongated aperture formed in the lower end portion of the one mating plate so as to firmly press the free end portions of said support strips against the inside of the other mating plate.

6. A golf bag comprising:

a head cover assembly for holding and protecting the heads of golf clubs from colliding with each other in a golf bag having a frame with a top and a bottom part;

a plurality of elastic head covers for respectively covering the heads of golf clubs; and a rigid head cover holder fastened to the frame for fixedly holding said head covers at suitable intervals, whereby said heads are respectively and fixedly held by said elastic head covers so as to make at least said heads substantially immovable in the golf bag;

wherein each of said elastic head covers comprises a head covering part for covering the head of a golf club, and an elongated elastic support strip connected to said head covering part, said elastic support strip being held by said head cover holder; and wherein said head cover holder comprises a pair of rigid mating plates for receiving said elastic support strips between them, and a catching device for firmly fixing the free end portions of said support strips.

7. A golf bag as defined in claim 6, wherein one of said mating plates provided with a plurality of grooves for respectively receiving said support strips, and the other with a plurality of corresponding slits for allowing view of said support strips from the outside when mating said mating plates with said support strips interposed between them.

8. A golf bag as defined in claim 7, wherein said catching device comprises a plurality of catching blocks securely fixed in corresponding apertures formed in the lower portion of the one mating plate so as to firmly press the free end portions of said support strips against the inside of the other mating plate.

9. A golf bag as defined in claim 8, wherein said catching device comprises a single elongated catching block securely fixed in corresponding elongated aperture formed in the lower end portion of the one mating plate so as to firmly press the free end portions of said support strips against the inside of the other mating plate.

10. A golf bag as defined in 8, wherein said free end portions are arranged between said mating plates with the ends slightly protruding from the outside of the one mating plate.

* * * * *